US007891585B2

(12) United States Patent
Tsuchiya et al.

(10) Patent No.: US 7,891,585 B2
(45) Date of Patent: Feb. 22, 2011

(54) FUEL INJECTION VALVE

(75) Inventors: Tadao Tsuchiya, Miyagi (JP); Koji Sonoda, Miyagi (JP); Manabu Shoji, Miyagi (JP)

(73) Assignee: Keihin Corporation, Tokyo (JP)

( * ) Notice: Subject to any disclaimer, the term of this patent is extended or adjusted under 35 U.S.C. 154(b) by 197 days.

(21) Appl. No.: 12/294,385

(22) PCT Filed: Feb. 8, 2007

(86) PCT No.: PCT/JP2007/052196

§ 371 (c)(1),
(2), (4) Date: Sep. 24, 2008

(87) PCT Pub. No.: WO2007/122841

PCT Pub. Date: Nov. 1, 2007

(65) Prior Publication Data

US 2009/0165750 A1 Jul. 2, 2009

(30) Foreign Application Priority Data

Mar. 29, 2006 (JP) ..... 2006-090315
Mar. 29, 2006 (JP) ..... 2006-090316
Mar. 29, 2006 (JP) ..... 2006-090317

(51) Int. Cl.
*B05B 1/30* (2006.01)

(52) U.S. Cl. ..... 239/585.5; 239/102.2

(58) Field of Classification Search ... 239/585.1–585.5, 239/584, 102.2, 533.2, 533.9, 900; 251/129.15, 251/129.21, 127
See application file for complete search history.

(56) References Cited

U.S. PATENT DOCUMENTS 6,340,121 B1 * 1/2002 Lambert ..... 239/533.4
6,557,779 B2 * 5/2003 Perr et al. ..... 239/96

(Continued)

FOREIGN PATENT DOCUMENTS

JP 8-177677 A 7/1996

(Continued)

*Primary Examiner*—Davis Hwu
(74) *Attorney, Agent, or Firm*—Arent Fox LLP

(57) ABSTRACT

A fuel injection valve is provided that includes an electromagnetic actuator (A1) that moves a valve body (10) in an inwardly-opening direction, and a magnetostrictive actuator (A2) that, by passing current therethrough, elongates a movable part assembly (43) extending from the valve body (10) to a movable core (24) of the electromagnetic actuator (A1), wherein the magnetostrictive actuator (A2) is formed from a solid magnetostrictive element (15) provided between the valve body (10) and the movable core (24) of the electromagnetic actuator (A1) so as to couple the valve body (10) and the movable core (24), a preload spring (13) provided between the valve body (10) and the movable core (24) so as to apply a compressive preload in the axial direction of the valve body (10) to the magnetostrictive element (15), and a second coil (42) mounted on a valve housing (H) housing the valve body (10), the movable core (24), the magnetostrictive element (15), and the preload spring (13), the second coil (42) elongating the magnetostrictive element (15) against the preload by the passage of current. By combining in this way the electromagnetic actuator and the magnetostrictive actuator equipped with the solid magnetostrictive element, a fuel injection valve of an inwardly-opening type that has good responsiveness and is capable of operating at low power consumption can be provided.

6 Claims, 9 Drawing Sheets

U.S. PATENT DOCUMENTS

| | | | | |
|---|---|---|---|---|
| 6,575,385 | B1 * | 6/2003 | Stier | 239/102.2 |
| 6,866,204 | B2 * | 3/2005 | Becker et al. | 239/5 |
| 2003/0226905 | A1 * | 12/2003 | Cotton et al. | 239/102.2 |

FOREIGN PATENT DOCUMENTS

| | | | |
|---|---|---|---|
| JP | 2000-257527 | A | 9/2000 |
| JP | 2000-262076 | A | 9/2000 |
| JP | 2002-295330 | A | 10/2002 |
| JP | 2005-113699 | A | 4/2005 |
| WO | WO 00/08353 | A1 | 2/2000 |

* cited by examiner

FIRST OPERATING STATE ( $\alpha = \beta$ )

SECOND OPERATING STATE ( $\alpha > \beta$ )

FUEL INJECTION VALVE

CROSS-REFERENCE TO RELATED APPLICATION

This application is a National Stage entry of International Application No. PCT/JP2007/052196 filed Feb. 8, 2007, the entire specification claims and drawings of which are incorporated herewith by reference.

TECHNICAL FIELD

The present invention relates to a fuel injection valve mainly used in a fuel supply system of an internal combustion engine and, in particular, to a fuel injection valve that includes a valve body that can be seated on a valve seat connected to an inner end of a fuel injection hole, a return spring that urges the valve body in the seating direction, an electromagnetic actuator that, by passing current therethrough, moves the valve body in an inwardly-opening direction, and a magnetostrictive actuator that, by passing current therethrough, elongates a movable part assembly extending from the valve body to a movable core of the electromagnetic actuator.

BACKGROUND ART

Conventionally, a fuel injection valve that includes a magnetostrictive actuator that rapidly elongates or contracts a magnetostrictive element by the application/removal of a magnetic field to thus open and close a valve body is already known, as disclosed in Patent Publications 1 and 2.

Patent Publication 1: Japanese Patent Application Laid-open No. 2002-295330

Patent Publication 2: Japanese Patent Application Laid-open No. 2000-257527

DISCLOSURE OF INVENTION

Problems to be Solved by the Invention

In one disclosed in Patent Publication 1, a magnetostrictive element of a magnetostrictive actuator is formed in a hollow cylindrical shape surrounding a valve body; one end, on the valve seat side, of the magnetostrictive element is secured to a valve housing, and the other end thereof is connected to the valve body and formed as an inwardly-opening type, but in such an arrangement it is difficult to obtain a sufficient amount of elongation due to the magnetostrictive element being made hollow, and in order to obtain the amount of elongation actually required it is necessary to employ a very long magnetostrictive element. As a result the length of the fuel injection valve increases, the responsiveness of a movable part that includes the valve body deteriorates due to an increase in the weight of the movable part, and the amount of wear of abutting portions of the movable part and a fixed part increases.

Furthermore, one disclosed in Patent Publication 2 employs a solid magnetostrictive element, but since a movable part that includes a valve body has a small size but an outwardly-opening structure, it is difficult for a valve part of the valve body positioned outside a fuel injection hole to form a desired fuel spray form.

Moreover, in those disclosed in Patent Publications 1 and 2, since the valve body is opened and closed by elongation and contraction of only the magnetostrictive actuator, the power consumption increases.

The present invention has been accomplished in the light of such circumstances, and it is an object thereof to provide a fuel injection valve of an inwardly-opening type that has good responsiveness and is capable of operating at low power consumption by combining an electromagnetic actuator and a magnetostrictive actuator equipped with a solid magnetostrictive element.

Means for Solving the Problems

In order to attain the above object, according to a first aspect of the present invention, there is provided a fuel injection valve comprising a valve body that can be seated on a valve seat connected to an inner end of a fuel injection hole, a return spring that urges the valve body in the seating direction, an electromagnetic actuator that, by passing current therethrough, moves the valve body in an inwardly-opening direction, and a magnetostrictive actuator that, by passing current therethrough, elongates a movable part assembly extending from the valve body to a movable core of the electromagnetic actuator, wherein the magnetostrictive actuator is formed from a solid magnetostrictive element provided between the valve body and the movable core of the electromagnetic actuator so as to couple the valve body and the movable core, a preload spring provided between the valve body and the movable core so as to apply a compressive preload in the axial direction of the valve body to the magnetostrictive element, and a second coil mounted on a valve housing housing the valve body, the movable core, the magnetostrictive element, and the preload spring and forming between these and the valve housing a fuel flow path communicating with the fuel injection hole, the second coil elongating the magnetostrictive element against the preload by the passage of current.

According to a second aspect of the present invention, control of the passage of current through the second coil is carried out separately from the electromagnetic actuator.

According to a third aspect of the present invention, in addition to the first or second aspect, connected to one end of a magnetic material core housing tube, of the valve housing, housing the movable core is a magnetic path-forming first coil housing tube housing the electromagnetic actuator, and connected to the other end thereof is a magnetic path-forming second coil housing tube housing the second coil.

According to a fourth aspect of the present invention, in addition to the second aspect, the passage of current through the electromagnetic actuator is started prior to the passage of current through the magnetostrictive actuator while taking into consideration a lag in operation of the electromagnetic actuator.

According to a fifth aspect of the present invention, in addition to the second aspect, when opening the valve body, the electromagnetic actuator and the magnetostrictive actuator are first operated at substantially the same time, and subsequently, while maintaining the operating state of the electromagnetic actuator, the operation of the magnetostrictive actuator is canceled or the amount of operation thereof is decreased.

According to a sixth aspect of the present invention, in addition to the second aspect, while the valve body is opened by operation of the electromagnetic actuator the movable part assembly is contracted by controlling the current passing through the magnetostrictive actuator, and when the valve body is closed the passage of current through the electromagnetic actuator is first cut off in while passing current through the magnetostrictive actuator, and the passage of current through the magnetostrictive actuator is subsequently cut off.

According to a seventh aspect of the present invention, there is provided a fuel injection valve comprising a valve body that can be seated on a valve seat connected to an inner end of a fuel injection hole, a return spring that urges the valve body in the seating direction, an electromagnetic actuator that, by passing current therethrough, moves the valve body in an inwardly-opening direction, and a magnetostrictive actuator that, by passing current therethrough, elongates a movable part assembly extending from the valve body to a movable core of the electromagnetic actuator, the magnetostrictive actuator is formed from a solid magnetostrictive element provided between the valve body and a yoke member coupled, via a non-magnetic material middle member, integrally to the movable core of the electromagnetic actuator so as to couple the valve body and the yoke member, a preload spring connected between the valve body and the movable core so as to apply a compressive preload in the axial direction of the valve body to the magnetostrictive element, and a second coil mounted on a valve housing housing the valve body, the movable core, the magnetostrictive element, and the preload spring and forming between these and the valve housing a fuel flow path communicating with the fuel injection hole, the second coil elongating the magnetostrictive element against the preload by the passage of current.

According to an eighth aspect of the present invention, in addition to the seventh aspect, a journal part is formed on the outer periphery of the yoke member, the journal part having a larger diameter than that of the movable core and than that of the yoke member and being slidably fitted into an inner peripheral face of the valve housing.

According to a ninth aspect of the present invention, in addition to the eighth aspect, a pair of coaxially arranged coupling shafts are projectingly provided integrally with opposite end faces of the middle member, and these coupling shafts are respectively press-fitted into coupling holes provided in end faces, opposing the middle member, of the movable core and the yoke member to thus integrally couple the movable core, the middle member, and the yoke member.

According to a tenth aspect of the present invention, in addition to the ninth aspect, press-fitted portions of the middle member and the movable core and yoke member are welded.

According to an eleventh aspect of the present invention, in addition to the tenth aspect, recesses are formed in the outer periphery of the movable core and the yoke member, the recesses being recessed toward an outer peripheral face of the coupling shafts, and base walls of these recesses are respectively welded to the coupling shafts.

According to a twelfth aspect of the present invention, in addition to the eighth aspect, a movable core assembly comprising the movable core, the middle member, and the yoke member is provided with a series of through holes providing communication between axially opposite end faces of the movable core assembly and allowing fuel to pass through.

According to a thirteenth aspect of the present invention, there is provided a fuel injection valve comprising a valve body that can be seated on a valve seat connected to an inner end of a fuel injection hole, a return spring that urges the valve body in the seating direction, an electromagnetic actuator that, by passing current therethrough, moves the valve body in an inwardly-opening direction, and a magnetostrictive actuator that, by passing current therethrough, elongates a movable part assembly extending from the valve body to a movable core of the electromagnetic actuator, the magnetostrictive actuator is formed from a yoke member coupled to the movable core of the electromagnetic actuator, a magnetostrictive element assembly disposed between the yoke member and the valve body, a non-magnetic and hollow preload spring connected between the valve body and the yoke member while housing the magnetostrictive element assembly so as to apply a compressive preload in the axial direction of the valve body to the magnetostrictive element assembly, and a second coil mounted on a valve housing housing the valve body, the movable core, the magnetostrictive element assembly, and the preload spring and forming between these and the valve housing a fuel flow path communicating with the fuel injection hole, the second coil elongating the magnetostrictive element assembly against the preload by the passage of current.

According to a fourteenth aspect of the present invention, in addition to the thirteenth aspect, the preload spring is formed from a non-magnetic cylindrical body having a large number of through holes bored in a peripheral wall, and end parts of the yoke member and the valve body are respectively press-fitted into and welded to opposite end openings of the preload spring.

According to a fifteenth aspect of the present invention, in addition to the thirteenth aspect, the preload spring is formed from a bellows body, and end parts of the yoke member and the valve body are press-fitted into and welded to opposite end openings of the preload spring, thereby sealing the interior of the preload spring.

According to a sixteenth aspect of the present invention, in addition to any one of the thirteenth to fifteenth aspects, alignment means are provided between opposite ends of the magnetostrictive element assembly and the yoke member and valve body that oppose the opposite ends, the alignment means making the line of action of a preload that the preload spring applies to the magnetostrictive element assembly via the yoke member and the valve body conform to the axis of the magnetostrictive element assembly.

According to a seventeenth aspect of the present invention, in addition to the sixteenth aspect, the alignment means comprises an alignment member having one end face abutting against the magnetostrictive element assembly and the other end face abutting against the yoke member or the valve body, and portions where the alignment member and the yoke member or the valve body abut against each other are formed from a spherical convex face and a flat face or a conical concave face abutting against the spherical convex face.

According to an eighteenth aspect of the present invention, in addition to any one of the thirteenth to seventeenth aspects, the magnetostrictive element assembly is formed from a solid cylindrical inner magnetostrictive element, a cylindrical outer magnetostrictive element disposed so as to surround the inner magnetostrictive element, and a displacement transmission member comprising a non-magnetic middle tubular portion disposed between the inner and outer magnetostrictive elements, a front end member joined to the front end of the middle tubular portion 17*a* and supporting the front end of the outer magnetostrictive element, and a rear end member joined to the rear end of the middle tubular portion and supporting the rear end of the inner magnetostrictive element.

According to a nineteenth aspect of the present invention, in addition to the eighteenth aspect, the inner magnetostrictive element and the outer magnetostrictive element are each formed from a plurality of element blocks superimposed in the axial direction, and a shim is disposed between the element blocks.

Effects of the Invention

In accordance with the first aspect of the present invention, the movable part assembly can be elongated by elongation of the magnetostrictive element by passing current through the second coil. Therefore, when the electromagnetic actuator is operated in order to open the valve body, current is passed through the second coil so as to rapidly elongate the movable part assembly, the valve opening stroke of the movable core of the electromagnetic actuator is decreased by a corresponding amount, and the valve opening responsiveness of the valve body can thereby be enhanced.

Furthermore, during valve opening of the valve body, appropriately operating the magnetostrictive actuator enables the degree of opening of the valve body, that is, the amount of fuel injected, to be regulated. It is therefore possible to obtain responsiveness and a fuel injection ratio that are in accordance with required engine characteristics.

Moreover, since the magnetostrictive actuator includes the solid magnetostrictive element provided so as to couple the valve body and the movable core, it is possible to give a sufficient amount of elongation to the movable part assembly while avoiding an increase in size of the magnetostrictive actuator.

Furthermore, since, when the valve body is opened, it attains an inwardly-opened state, a spray form with a desired shape can be obtained without interference from the valve body.

In accordance with the second aspect of the present invention, since, when current is passed through the first coil, the amount of current passed through the second coil can be controlled independently thereof, it is possible to control a variable fuel injection ratio, multi-stage injection, etc. In this process, since in order to increase the degree of opening of the valve body in particular, the amount of current passed through the second coil or cutoff of the passage of current is carried out, it is possible to save power.

In accordance with the third aspect of the present invention, the magnetic material core housing tube that houses the movable core is utilized as a common magnetic path for the electromagnetic actuator and the magnetostrictive actuator, thus reducing the number of components and consequently contributing to making the structure simple and compact.

In accordance with the fourth aspect of the present invention, it is possible to eliminate any operating lag of the electromagnetic actuator relative to the magnetostrictive actuator and contribute to enhancing the valve opening responsiveness of the valve body.

In accordance with the fifth aspect of the present invention, it is possible to enhance the valve opening responsiveness of the valve body and, moreover, during valve opening, canceling the operation of the magnetostrictive actuator or reducing the amount of operation thereof enables a desired fuel injection ratio to be obtained.

In accordance with the sixth aspect of the present invention, during valve opening, canceling the operation of the magnetostrictive actuator or reducing the amount of operation thereof enables a desired fuel injection ratio to be obtained. When the valve is closed, immediately after the degree of opening of the valve body is made zero or small by passing current through the electromagnetic actuator and the magnetostrictive actuator, since the passage of current through the electromagnetic actuator is cut off, the valve closing stroke of the valve body is controlled so that it is zero or very small, and therefore, when the passage of current through the electromagnetic actuator is subsequently cut off, the impact of the valve closing is small, thus contributing to prevention of vibration of the valve body.

In accordance with the seventh aspect of the present invention, the movable part assembly can be elongated by elongation of the magnetostrictive element by passing current through the second coil. Therefore, when the electromagnetic actuator is operated in order to open the valve body, current is passed through the second coil to rapidly elongate the movable part assembly, and since the valve opening stroke of the movable core of the electromagnetic actuator is decreased by a corresponding degree, the valve opening responsiveness of the valve body is enhanced.

Furthermore, during valve opening of the valve body, appropriately operating the magnetostrictive actuator enables the degree of opening of the valve body, that is, the amount of fuel injected, to be regulated. It is therefore possible to obtain responsiveness and a fuel injection ratio that are in accordance with required engine characteristics. In particular, when the degree of opening of the valve body is increased, since the amount of current passed through the second coil or cutoff of the energization is carried out, it is possible to save power.

Moreover, since the magnetostrictive actuator includes the solid magnetostrictive element provided so as to couple the valve body and the movable core, it is possible to give a sufficient amount of elongation to the movable part assembly while avoiding an increase in size of the magnetostrictive actuator.

Furthermore, since, when the valve body is opened, it attains an inwardly-opened state, a spray form with a desired shape can be obtained without interference from the valve body.

Since the movable core of the electromagnetic actuator and the yoke member of the magnetostrictive actuator are coupled integrally via the non-magnetic material middle member, when the first and second actuators are in an operating state, interference between the magnetic flux within the movable core and the magnetic flux within the yoke member can be blocked by the middle member, thereby maintaining a good operating state for each actuator.

In accordance with the eighth aspect of the present invention, since the journal part of the magnetic material middle member slides against the inner peripheral face of the valve housing, side clearance between the valve housing and each of the movable core and the yoke member can always be made uniform, thereby stabilizing the magnetic properties. Furthermore, friction of the movable core and the yoke member against the valve housing can be minimized, and the durability thereof can be enhanced without applying a special abrasion resistance treatment. Moreover, a material with high abrasion resistance can be selected freely for the non-magnetic material middle member, and the durability thereof can easily be guaranteed.

In accordance with the ninth aspect of the present invention, the movable core and the yoke member can be coupled simply via the middle member while enhancing the coaxial precision.

In accordance with the tenth aspect of the present invention, the strength of coupling of each of the press-fitted portions between the middle member and the movable core and yoke member can be enhanced.

In accordance with the eleventh aspect of the present invention, since a relatively thin base wall of each recess of the movable core and the yoke member is welded to the coupling shaft of the middle member, good welding is possible with very little heat input; as a result it is possible to avoid deviation in the coaxial precision of the three, that is, the movable core, the middle member, and the yoke member due to the heat of welding, and also prevent any degradation in the hardness of the sliding portions and ensure that they are abrasion resistant.

In accordance with the twelfth aspect of the present invention, fuel can pass smoothly through the interior of the movable core assembly without being obstructed by the journal part of the middle member, thus suppressing fuel injection pressure loss.

In accordance with the thirteenth aspect of the present invention, the movable part assembly can be elongated by elongation of the magnetostrictive element assembly by passing current through the second coil. Therefore, when the electromagnetic actuator is operated in order to open the valve body, current is passed through the second coil so as to rapidly elongate the movable part assembly, the valve opening stroke of the movable core of the electromagnetic actuator is decreased by a corresponding degree, and the valve opening responsiveness of the valve body can thereby be enhanced.

Furthermore, during valve opening of the valve body, appropriately operating the magnetostrictive actuator enables the degree of opening of the valve body, that is, the amount of fuel injected, to be regulated. It is therefore possible to obtain responsiveness and a fuel injection ratio that are in accordance with required engine characteristics. In order to increase the degree of opening of the valve body in particular, since the amount of current passed through the second coil or cutoff of the passage of current is carried out, it is possible to save power.

Moreover, since it is possible to equip the magnetostrictive actuator with the solid magnetostrictive element in the magnetostrictive element assembly disposed between the valve body and the movable core, it is possible to give a sufficient amount of elongation to the movable part assembly while avoiding an increase in size of the magnetostrictive actuator.

Furthermore, since, when the valve body is opened, it attains an inwardly-opened state, a spray form with a desired shape can be obtained without interference from the valve body.

Moreover, the magnetostrictive element assembly disposed between the yoke member and the valve body is housed within the hollow preload spring that couples the yoke member and the valve body; this enables the movable part assembly extending from the movable core to the valve body to be made compact and the magnetostrictive element assembly therewithin to be protected by the preload member to thus guarantee its durability. Moreover, since the magnetostrictive element assembly is housed within the valve housing, it is not affected by outside air temperature or humidity, and even when there is a core misalignment between the yoke member and the valve body, this can be allowed by resilient deformation of the preload spring, and since no extra burden is imposed on the magnetostrictive element assembly, it is possible to ensure that the magnetostrictive element assembly operates stably and stabilize fuel injection properties of the fuel injection valve.

In accordance with the fourteenth aspect of the present invention, the preload spring can be formed so that it is as small as possible, the movable part assembly can be made small and lightweight, and at the same time the strength of the coupling of the preload spring with each of the yoke member and the valve body can be enhanced.

In accordance with the fifteenth aspect of the present invention, sealing the interior of the preload spring enables the magnetostrictive element assembly to be shielded from fuel within the valve housing, thus suppressing any degradation in the performance of the magnetostrictive element.

In accordance with the sixteenth aspect of the present invention, since a preload that the preload spring applies to the yoke member and the valve body acts via the alignment means on the magnetostrictive element assembly along the axis thereof, it is possible to avoid unnecessary side thrust being applied to the magnetostrictive element assembly even when it is elongated, thus improving its durability.

In accordance with the seventeenth aspect of the present invention, the alignment means can be formed simply.

In accordance with the eighteenth aspect of the present invention, since the inner magnetostrictive element and the outer magnetostrictive element are in effect coupled to each other in the axial direction via the displacement transmission member, when current is passed through the second coil, axial elongations of the two magnetostrictive elements are added to make an effective elongation length of the movable part assembly. This enables a desired amount of elongation to be guaranteed while achieving a small size for the magnetostrictive element assembly.

In accordance with the nineteenth aspect of the present invention, dividing each magnetostrictive element into a plurality of element blocks and superimposing them enables the durability of each magnetostrictive element to be improved while guaranteeing a desired amount of elongation for the magnetostrictive element assembly and, moreover, adjusting the thickness of the shim disposed between the element blocks enables the length of the magnetostrictive element assembly to be easily adjusted.

The above-mentioned object, other objects, features, and advantages of the present invention will become apparent from explanation of preferred embodiments described in detail below by reference to the attached drawings.

EXPLANATION OF REFERENCE NUMERALS AND SYMBOLS

Figure 1:
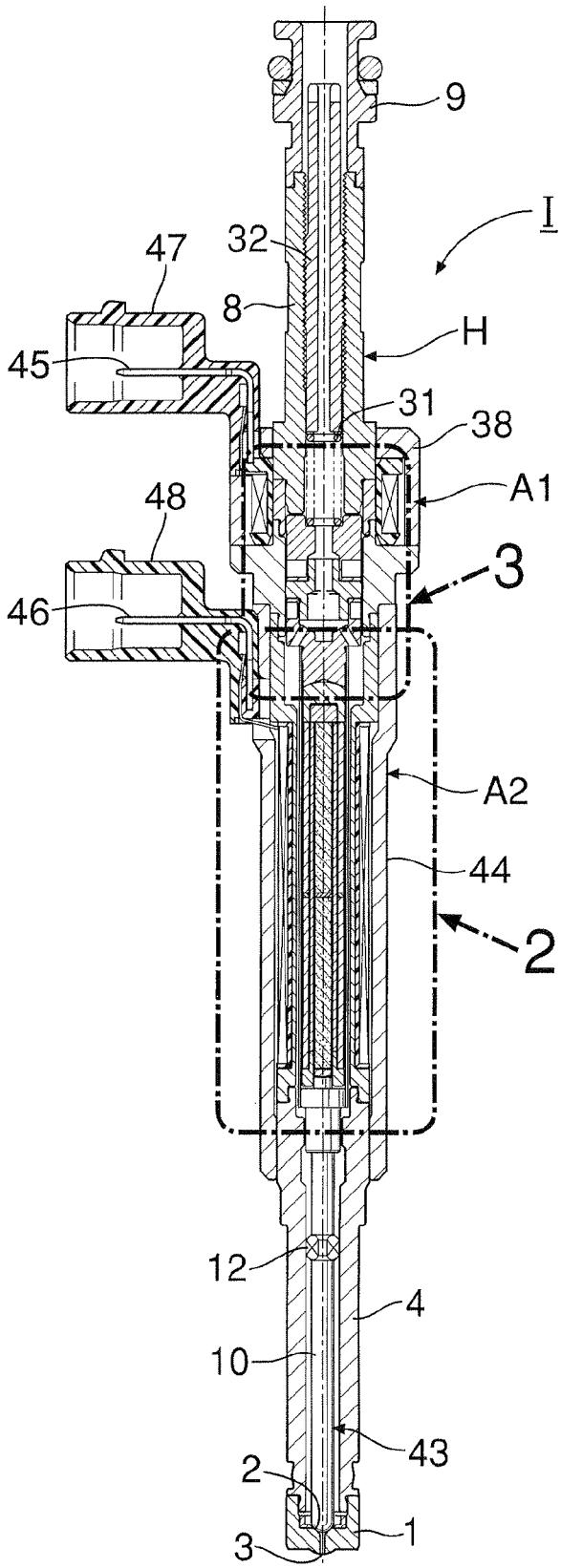
FIG. 1 is a sectional side view of an engine fuel injection valve of the present invention (first embodiment).

I Fuel injection valve
H Valve housing
A1 Electromagnetic actuator
A2 Magnetostrictive actuator
2 Valve seat
3 Fuel injection hole
10 Valve body
10*b* Flat face
13 Preload spring
14 Magnetostrictive element assembly
15 Solid magnetostrictive element (inner giant magnetostrictive element)

16 Outside magnetostrictive element (outer giant magnetostrictive element)
17 Displacement transmission member
17*a* Middle tubular portion
17*b* Front end member
17*c* Rear end member
19 Journal part
21 Alignment member (first alignment member)
21*a* Spherical convex face
22 Yoke member
22*a* Coupling hole
22*b* Recess
22*c* Conical concave face
23 Middle member
23*a*, 23*b* Coupling shaft
24 Movable core
24*a* Coupling hole
24*b* Recess
25 Movable core assembly
27 Through hole
28 Alignment member (second alignment member)
28*b* Spherical convex face
31 Return spring
37 First coil
38 First coil housing tube
42 Second coil
43 Movable part assembly
44 Second coil housing tube

BEST MODE FOR CARRYING OUT THE INVENTION

Preferred embodiments of the present invention are explained below by reference to the attached drawings.

Embodiment 1

Figure 2:
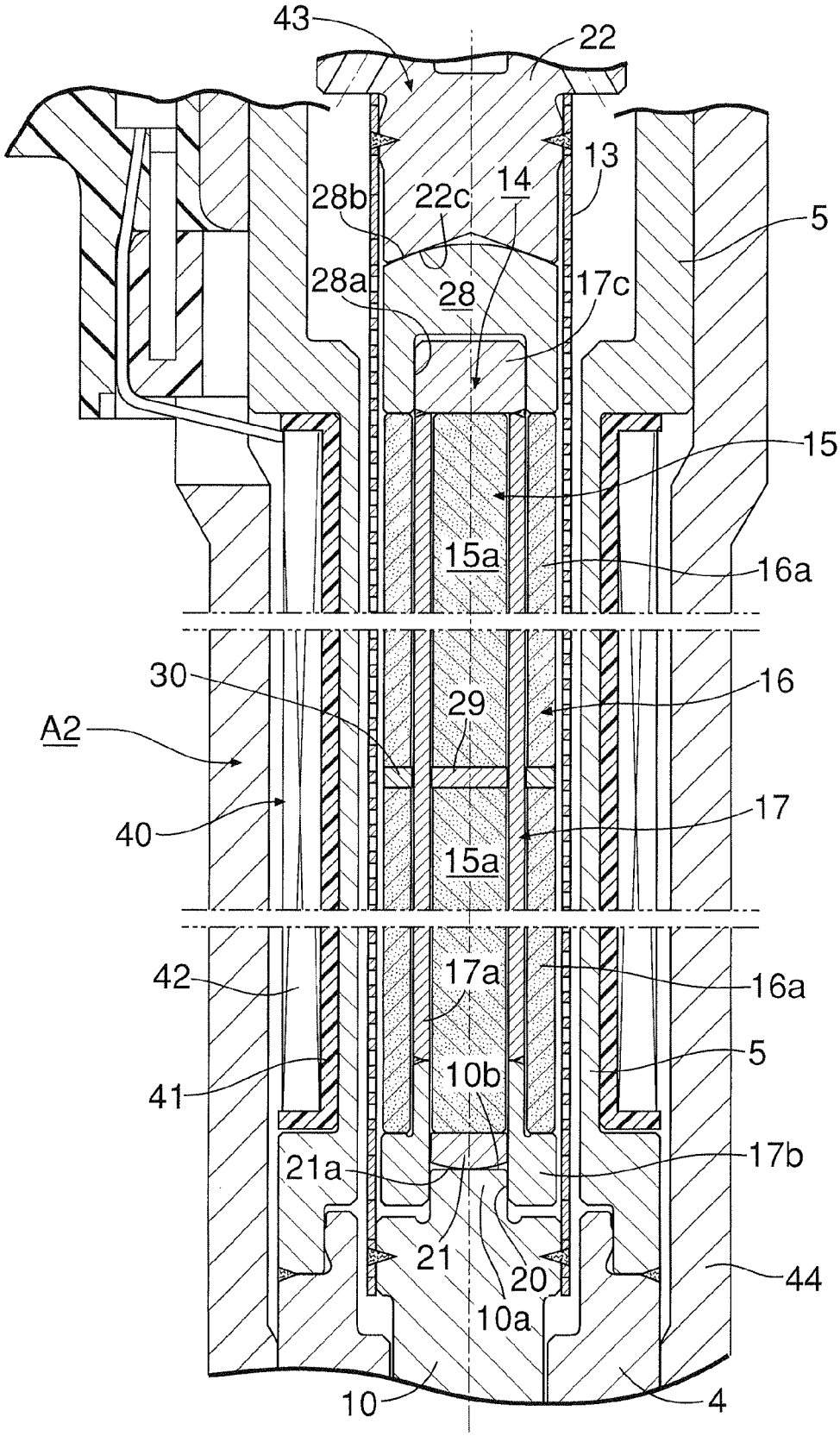
FIG. 2 is an enlarged view of part 2 in FIG. 1 (first embodiment).
Figure 3:
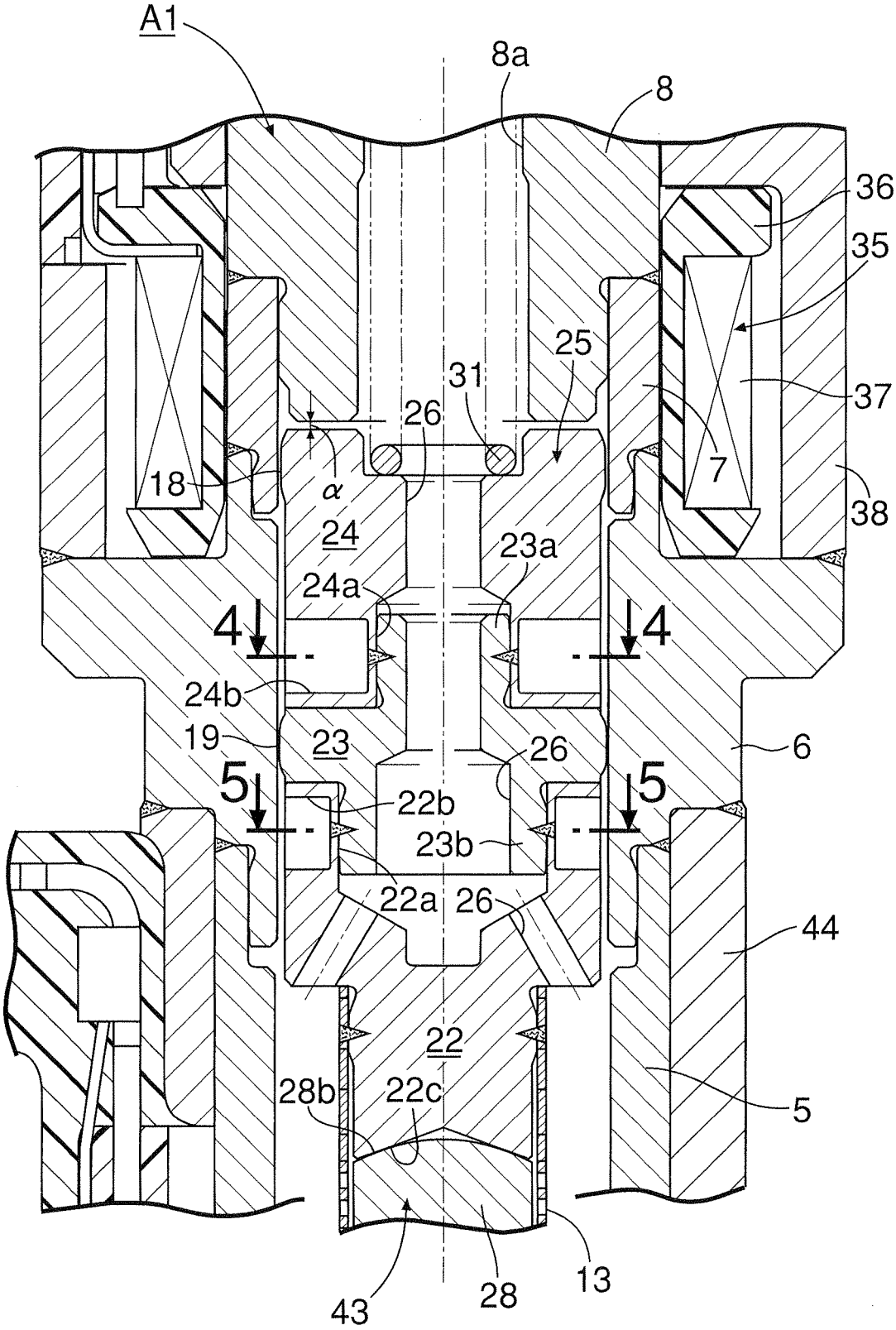
FIG. 3 is an enlarged view of part 3 in FIG. 1 (first embodiment).

A first embodiment of the present invention is explained by reference to FIG. 1 to FIG. 9; first, in FIG. 1 to FIG. 3, reference symbol 1 is a direct fuel injection valve mounted on a cylinder head of an engine. In the explanation of the fuel injection valve I, 'front' means on a fuel injection hole 3 side, and 'rear' means on a fuel inlet side.

A valve housing H of the fuel injection valve I is formed from a bottomed cylindrical valve seat member 1 having a conical valve seat 2 on a front end wall and a fuel injection hole 3 opening in the center thereof, a valve guide tube 4 (magnetic material) fitted into and joined in a liquid-tight manner to a rear end part of the valve seat member 1, a magnetostrictive housing tube 5 (non-magnetic material) fitted onto and joined in a liquid-tight manner to a rear end part of the valve guide tube 4, a core housing tube 6 (magnetic material) fitted into and joined in a liquid-tight manner to a rear end part of the magnetostrictive housing tube 5, a middle tube 7 (non-magnetic material) fitted into and joined in a liquid-tight manner to a rear end part of the core housing tube 6, a hollow cylindrical fixed core 8 (magnetic material) fitted into and joined in a liquid-tight manner to a rear end part of the middle tube 7, and a fuel inlet tube 9 joined in a liquid-tight manner to a rear end part of the fixed core 8.

A fuel distribution pipe (not illustrated) for supplying high pressure fuel is connected to the fuel inlet tube 9, and the interior of the valve housing H is a fuel flow path extending from the fuel inlet tube 9 to the fuel injection hole 3.

A needle-shaped valve body 10 having, at its front end, a spherical valve part that can be seated on the valve seat 2 is housed in the valve guide tube 4 so as to ensure that there is a tubular fuel flow path on the outer periphery thereof. Injection from the fuel injection hole 3 of high pressure fuel within the valve housing H is controlled by opening and closing of the valve body 10, that is, separating it from the valve seat 2 and seating it thereon.

A journal part 12 slidably supported on an inner peripheral face of the valve guide tube 4 is formed in a middle part of the valve body 10, and a chamfered part is provided on the outer periphery of the journal part 12, the chamfered part providing communication between opposite front and rear end faces and allowing fuel to pass through.

The magnetostrictive housing tube 5 houses a cylindrical preload spring 13 (non-magnetic material) and a magnetostrictive element assembly 14 disposed inside the preload spring 13. The magnetostrictive element assembly 14 is formed from a solid columnar inner giant magnetostrictive element 15, a cylindrical outer giant magnetostrictive element 16 disposed so as to surround same, and a displacement transmission member 17 that includes a middle tubular portion 17*a* disposed between these inner and outer giant magnetostrictive elements 15 and 16, a front end member 17*b* (magnetic material) formed at the front end of the middle tubular portion 17*a* (non-magnetic material) and supporting the front end of the outer giant magnetostrictive element 16, and a rear end member 17*c* (magnetic material) formed at the rear end of the middle tubular portion 17*a* and supporting the rear end of the inner giant magnetostrictive element 15. This displacement transmission member 17 in effect couples the inner giant magnetostrictive element 15 and the outer giant magnetostrictive element 16 to each other in the axial direction.

The core housing tube 6 houses a movable core/yoke member combination 25 formed by coupling a yoke member 22 (magnetic material) to the front end of a movable core 24 (magnetic material) via a middle member 23 (non-magnetic material).

Annular journal parts 18 and 19 are formed on the outer periphery of the movable core 24 and the middle member 23, the journal parts 18 and 19 protruding and being slidably fitted into inner peripheral faces of the middle tube 7 and the core housing tube 6 respectively. This enables a non-tilted stable sliding attitude of the movable core/yoke member combination 25 to be maintained. Side clearances between the movable core 24 and the middle tube 7 and between the yoke member 22 and the core housing tube 6 can always be made uniform, thus stabilizing magnetic properties. Furthermore, friction between the movable core 24 and the middle tube 7 and that between the yoke member 22 and the core housing tube 6 can be minimized, and it is therefore possible to enhance the durability thereof without applying a special abrasion resistance treatment. Moreover, a material with high abrasion resistance can be freely selected for the non-magnetic material middle member 23, and the durability thereof can also easily be guaranteed.

Figure 4:
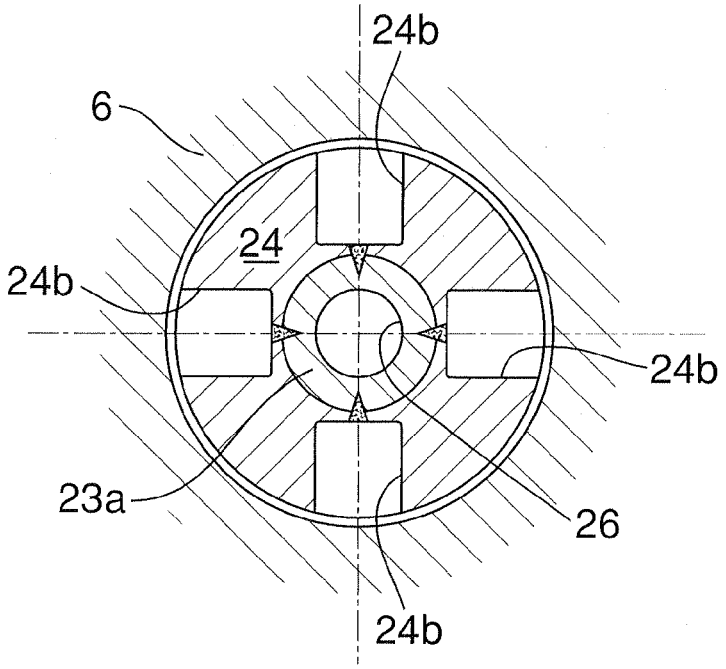
FIG. 4 is a sectional view along line 4-4 in FIG. 3 (first embodiment).
Figure 5:
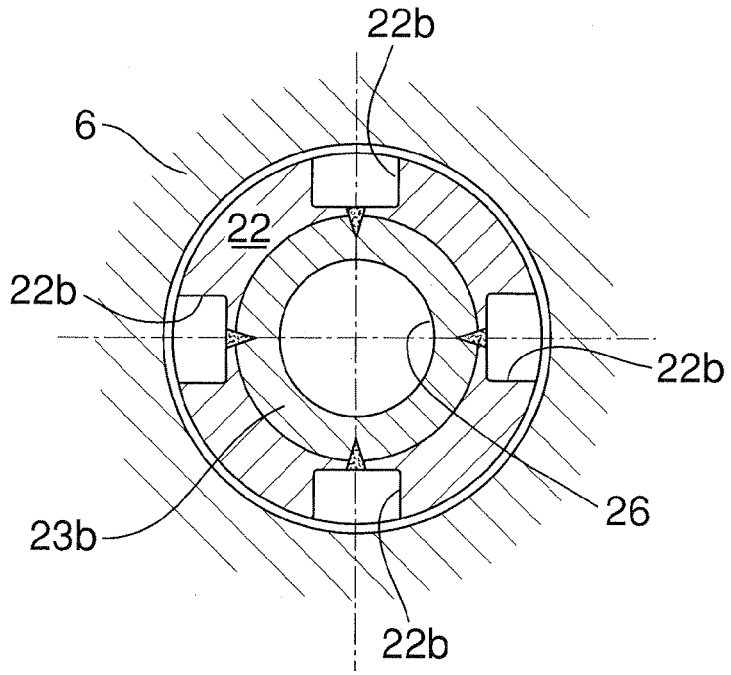
FIG. 5 is a sectional view along line 5-5 in FIG. 3 (first embodiment).

In FIG. 4 and FIG. 5, the coupling structure for the yoke member 22, the middle member 23, and the movable core 24, which form the movable core/yoke member combination 25, is explained. A pair of coaxially arranged small diameter coupling shafts 23*a* and 23*b* are formed integrally with axially opposite end faces of the middle member 23. Meanwhile, coupling holes 24*b* and 22*b* are provided in end faces of the movable core 24 and the yoke member 22 that oppose the middle member 23, and the three, that is, 22 to 24, are integrally coupled by press-fitting the coupling shafts 23*a* and 23*b* into these coupling holes 24*b* and 22*b*. By so doing, it is possible to easily provide a coupling between the movable core 24 and the yoke member 22 while enhancing the coaxial precision thereof.

Furthermore, a plurality of recesses 24*b* and 22*b* recessed toward the outer peripheral faces of the coupling shafts 23*a* and 23*b* are respectively formed in the outer periphery of the movable core 24 and the yoke member 22, and base walls of these recesses 24*b* and 22*b* are respectively welded to outer peripheral parts of the coupling shafts 23*a* and 23*b*. This welding is suitably laser welding. By so doing, the coupling strength of each of the press-fitted portions between the middle member 23 and the movable core 24 and yoke member 22 can be enhanced. Moreover, when welding the relatively thin base wall of each of the recesses 24*b* and 22*b* of the movable core 24 and the yoke member 22 to the coupling shafts 23*a* and 23*b* of the middle member 23, very little heat input is required, and it is therefore possible to avoid deviation in the coaxial precision of the three, that is, the movable core 24, the middle member 23, and the yoke member 22 due to the heat of welding.

The movable core/yoke member combination 25 thus arranged is provided with a series of through holes 26 providing communication between opposite front and rear end faces thereof and allowing fuel to pass through. It is therefore possible for fuel to smoothly pass through the interior of the movable core/yoke member combination 25 without being obstructed by the journal part 18 of the movable core 24 or the journal part 19 of the middle member 23, thus suppressing fuel injection pressure loss and maintaining good fuel injection properties.

Referring again to FIG. 2, the front end member 17*b* has a guide hole 20 that is continuous with a hollow part of the middle tubular portion 17*a* of the displacement transmission member 17, and a small diameter shaft portion 10*a* formed at the rear end of the valve body 10 and a first alignment member 21 (magnetic material) disposed between the small diameter shaft portion 10*a* and the inner giant magnetostrictive element 15 are slidably fitted into the guide hole 20. A gap for allowing tilting of the first alignment member 21 is provided between the first alignment member 21 and an inner peripheral face of the guide hole 20. A front end face of the first alignment member 21 is formed as a spherical convex face 21*a*, and abuts against a central part of a flat face 10*b* at the rear end of the small diameter shaft portion 10*a*. Therefore, even if an end face of the inner giant magnetostrictive element 15 that abuts against the first alignment member 21 is slightly inclined, although the first alignment member 21 tilts accordingly, no change is caused in the abutting relationship between the spherical convex face 21*a* of the first alignment member 21 and the flat face 10*b* of the small diameter shaft portion 10*a*.

On the other hand, the yoke member 22 is disposed so as to abut against the rear end of the outer giant magnetostrictive element 16 via a second alignment member 28. The second alignment member 28 has a guide hole 28*a* that slidably receives the rear end member 17*c*, a rear end face of the second alignment member 28 is formed as a spherical convex face 28*b*, and this spherical convex face 28*b* abuts against a conical concave face 22*c* formed on a front end face of the yoke member 22. Therefore, even if an end face of the outer giant magnetostrictive element 16 that abuts against the second alignment member 28 is slightly inclined, the second alignment member 28 tilts accordingly, but no change is caused in the abutting relationship between the spherical convex face 28*b* of the second alignment member 28 and the conical concave face 22*c* of the yoke member 22.

Therefore, by cooperation of the first and the second alignment members 21 and 28, the line of action of a preload that the preload spring 13 applies to the magnetostrictive element assembly 14 via the yoke member 22 and the valve body 10 can conform to the axis of the magnetostrictive element assembly 14, and it is thereby possible to avoid unnecessary side thrust being applied to the magnetostrictive element assembly 14 even when it is elongated, thus improving its durability.

Figure 6:
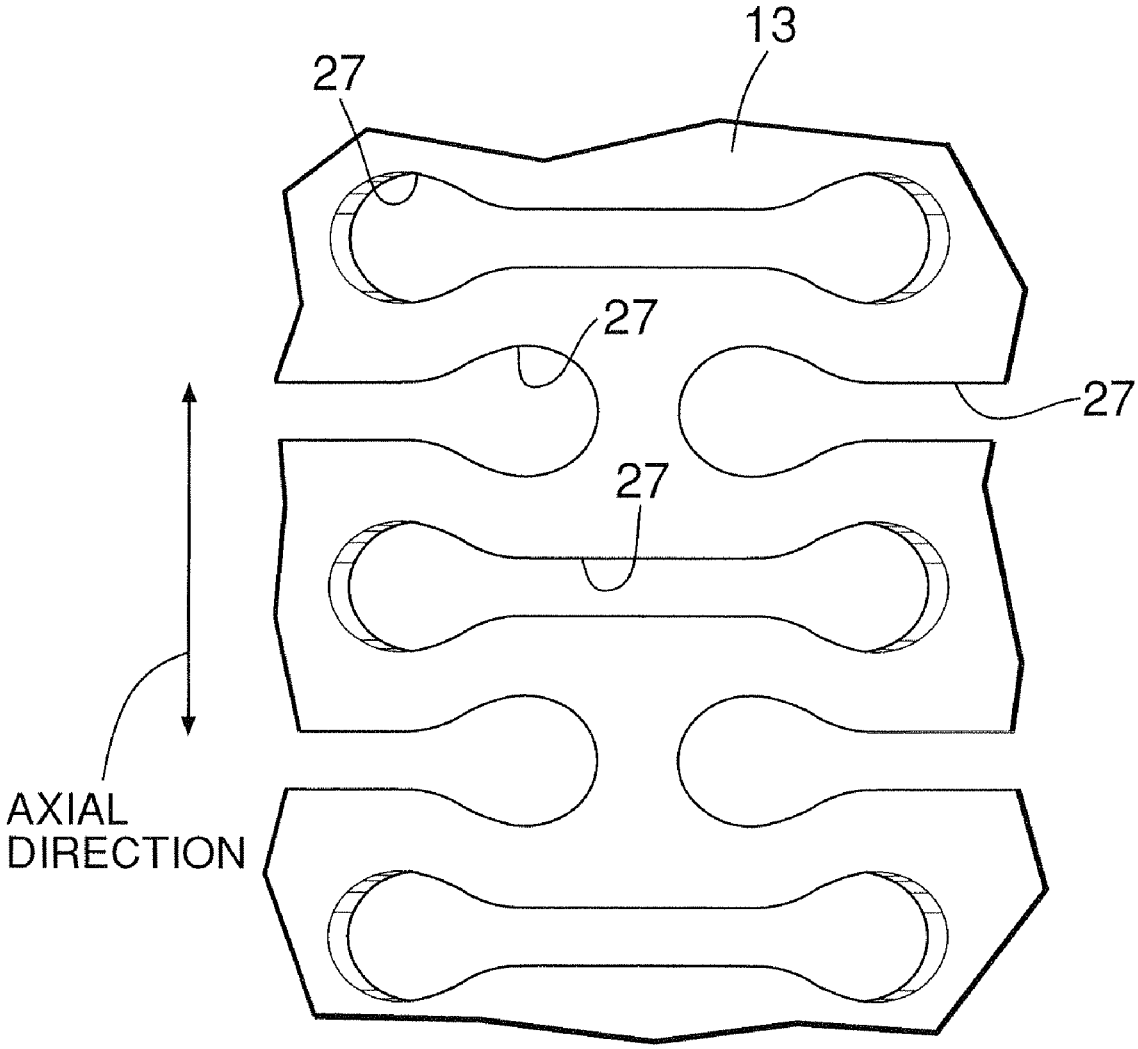
FIG. 6 is an enlarged partial side view of a preload spring in the fuel injection valve (first embodiment).

The preload spring 13 is formed by rolling up a non-magnetic spring steel punched plate having a large number of through holes 27 formed therein as shown in FIG. 6 into a cylindrical shape and joining opposing ends to each other, and axially opposite end parts thereof are installed and press-fitted onto a rear end part of the valve body 10 and a front end part of the yoke member 22 and welded while applying a predetermined axial compressive load to the inner giant magnetostrictive element 15 and the outer giant magnetostrictive element 16, thus firmly securing them. The preload spring 13 applies an axial compressive preload to the inner giant magnetostrictive element 15 and the outer giant magnetostrictive element 16, thus maintaining them in a state with a predetermined amount of compressive deformation.

The preload spring 13 having the arrangement above can be formed so as to have a small diameter so that the entirety thereof is in proximity to the outer periphery of the magnetostrictive element assembly 14, and a movable part assembly 43 extending from the movable core 24 to the valve body 10 can be made compact. Moreover, since the preload spring 13 houses the magnetostrictive element assembly 14 therewithin, not only can the magnetostrictive element assembly 14 be protected and its durability guaranteed, but also the magnetostrictive element assembly 14 is housed in the valve housing H together with the preload spring 13, and it is not affected by outside air temperature or humidity. Furthermore, even when there is core misalignment between the yoke member 22 and the valve body 10, this can be allowed by resilient deformation of the preload spring 13, and since no extra burden is imposed on the magnetostrictive element assembly 14, it is possible to ensure that the magnetostrictive element assembly 14 operates stably.

The inner giant magnetostrictive element 15 and the outer giant magnetostrictive element 16 are formed from a plurality of element blocks 15*a* and 15*a*; 16*a* and 16*a* superimposed in the axial direction, and shims 29 and 30 are disposed between the element blocks 15*a* and 15*a*; 16*a* and 16*a*.

In this way, dividing each of the magnetostrictive elements 15 and 16 into the plurality of element blocks and superimposing them enables the durability of each of the magnetostrictive elements 15 and 16 to be improved while guaranteeing a desired amount of elongation for the magnetostrictive element assembly 14 and, moreover, adjusting the thickness of the shims 29 and 30 disposed between the element blocks 15*a* and 15*a*; 16*a* and 16*a* enables the length of the magnetostrictive element assembly 14 to be easily adjusted.

The movable core 24 is disposed so as to face a lower end face of the fixed core 8 across a gap $\alpha$ corresponding to a predetermined valve opening stroke in a state where the valve body 10 is seated on the valve seat 2. The fixed core 8 has a hollow portion 8*a* providing communication between opposite front and rear end faces thereof, a coil-shaped return spring 31 urging the movable core 24 in a direction that closes the valve body 10 and a pipe-shaped retainer 32 supporting a fixed end of the return spring 31 in order to apply a set load thereto are provided in the hollow portion 8*a*, and this retainer 32 is secured to the inner peripheral face of the hollow portion 8*a* by screwing or press-fitting.

A first coil assembly 35 is disposed on the outer periphery from a rear end part of the core housing tube 6 to a front end part of the fixed core. This first coil assembly 35 is formed from a first bobbin 36 fitted around outer peripheral faces from the rear end part of the core housing tube 6 to the front end part of the fixed core, and a first coil 37 wound around the outer periphery thereof, and a first coil housing tube 38 (magnetic material) housing the first coil assembly 35 is disposed so as to couple the core housing tube 6 and the fixed core 8.

The first fixed core 8, the movable core 24, the first coil assembly 35, the core housing tube 6, and the first coil housing tube 38 form an electromagnetic actuator A1 for opening and closing the valve body 10 in cooperation with the return spring 31. When current is passed through the first coil 37, a resulting magnetic flux runs in sequence through the fixed core 8, the first coil housing tube 38, the core housing tube 6, and the movable core 24, and a magnetic force enables the movable core 24 to be attracted toward the fixed core 8 side against the set load of the return spring 31, thus opening the valve body 10.

A second coil assembly 40 is disposed on the outer periphery of the magnetostrictive housing tube 5 so as to correspond to the two giant magnetostrictive elements 15 and 16. This second coil assembly 40 is formed from a second bobbin 41 fitted around an outer peripheral face of the magnetostrictive housing tube 5 and a second coil 42 wound around the outer periphery thereof, and a second coil housing tube 44 (magnetic material) housing this second coil assembly 40 is disposed so as to couple the valve guide tube 4 and the core housing tube 6.

The inner giant magnetostrictive element 15, the outer giant magnetostrictive element 16, the displacement transmission member 17, the preload spring 13, the yoke member 22, the second coil assembly 40, the core housing tube 6, and the second coil housing tube 44 form a magnetostrictive actuator A2 that can change the effective length of the movable part assembly 43, which is a movable part integrated from the valve body 10 to the movable core 24. When current is passed through the second coil 42, a resulting magnetic flux runs in sequence through the second coil housing tube 44, the valve guide tube 4, the two giant magnetostrictive elements 15 and 16, the yoke member 22, and the core housing tube 6, a magnetic field is thus applied to the two giant magnetostrictive elements 15 and 16, and the two giant magnetostrictive elements 15 and 16 elongate in the axial direction according to the intensity of the magnetic field, thus increasing the effective length of the movable part assembly 43. In this process, the two giant magnetostrictive elements 15 and 16 are in effect coupled to each other in the axial direction via the displacement transmission member 17, axial elongations of the two giant magnetostrictive element 15 and 16 are added, and this sum is the increase in effective length of the movable part assembly 43. This enables a desired amount of elongation to be guaranteed while achieving a reduction in size for the magnetostrictive element assembly 14.

The core housing tube 6 (magnetic material) forming part of the valve housing H and housing the movable core/yoke member combination 25 is disposed so as to couple a first coil housing (magnetic material) housing the first coil 37 and a second coil housing (magnetic material) housing the second coil 42, and is utilized as a common magnetic path for the electromagnetic actuator A1 and the magnetostrictive actuator A2, thus reducing the number of components and consequently contributing to making the structure simple and compact.

Furthermore, since the movable core 24 of the electromagnetic actuator A1 and the yoke member 22 forming part of the magnetostrictive actuator A2 are coupled integrally via the non-magnetic material middle member 23 so as to form the movable core/yoke member combination 25, when the two actuators A1 and A2 are in an operating state, interference between the magnetic flux within the movable core 24 and the magnetic flux within the yoke member 22 can be blocked by the middle member 23, thereby guaranteeing a good operating state for each of the actuators A1 and A2.

A first coupler 47 supporting a first power supply terminal 45 connected to the first coil 37 is formed integrally with the first bobbin 36, and a second coupler 48 supporting a second power supply terminal 46 connected to the second coil 42 is formed integrally with the second coil housing tube 44.

Figure 7:
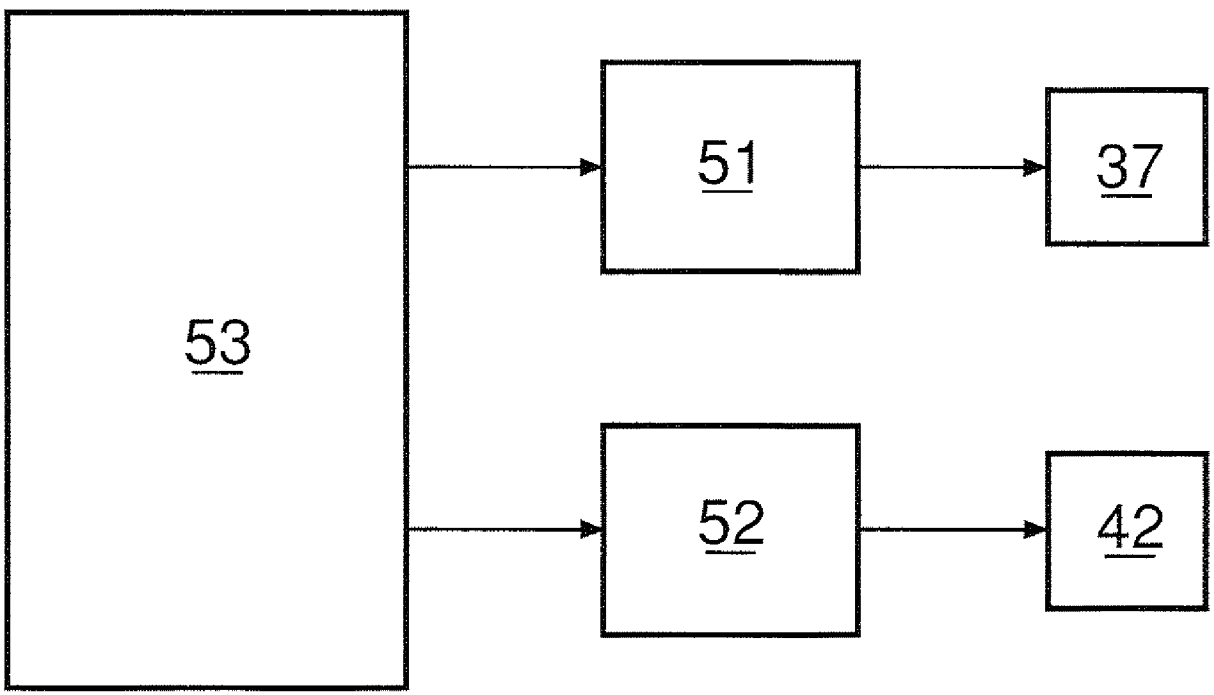
FIG. 7 is a drive circuit diagram for first and second coils in the fuel injection valve (first embodiment).
Figure 8:
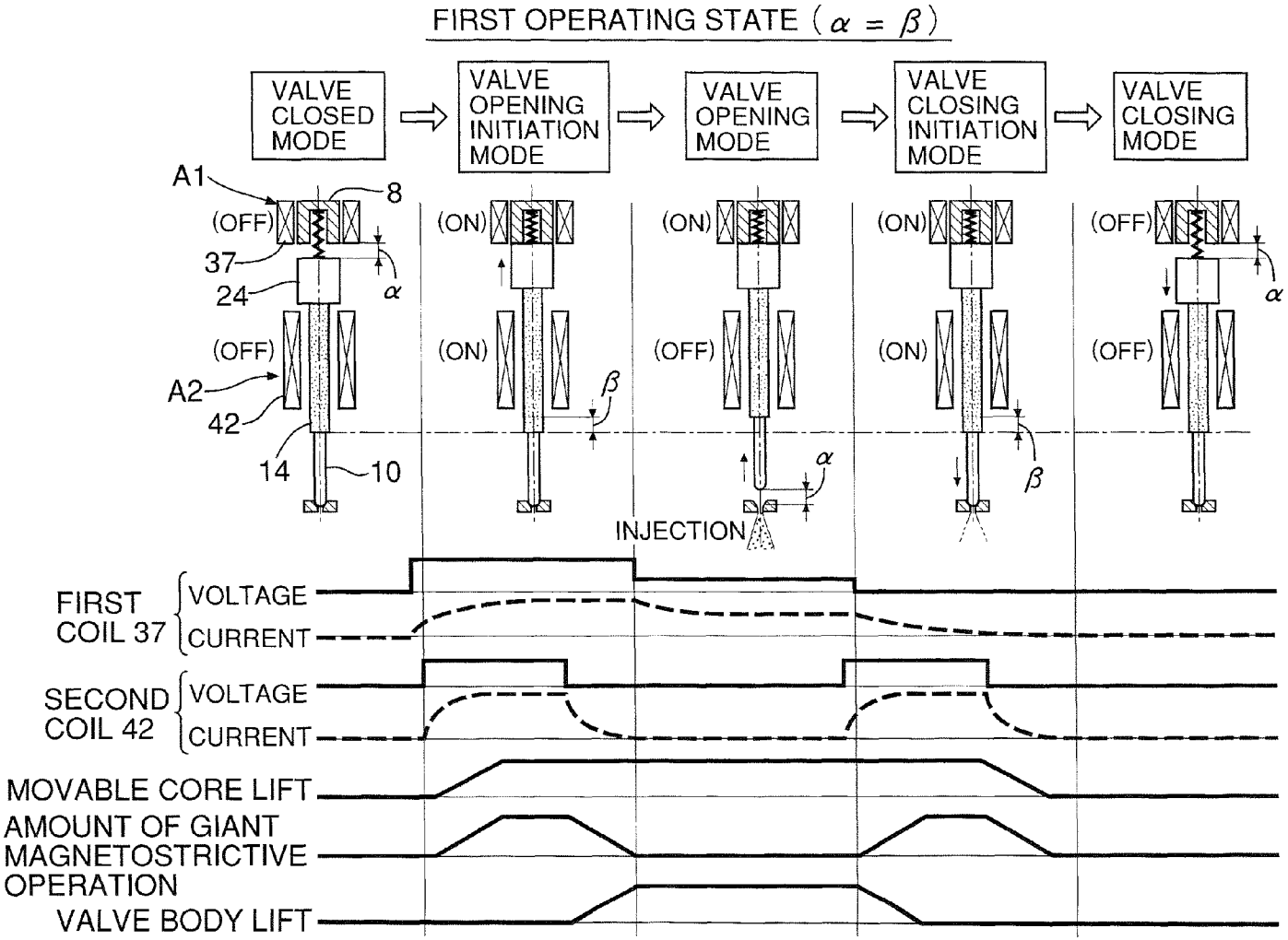
FIG. 8 is a diagram for explaining a first operating mode of the fuel injection valve (first embodiment).
Figure 9:
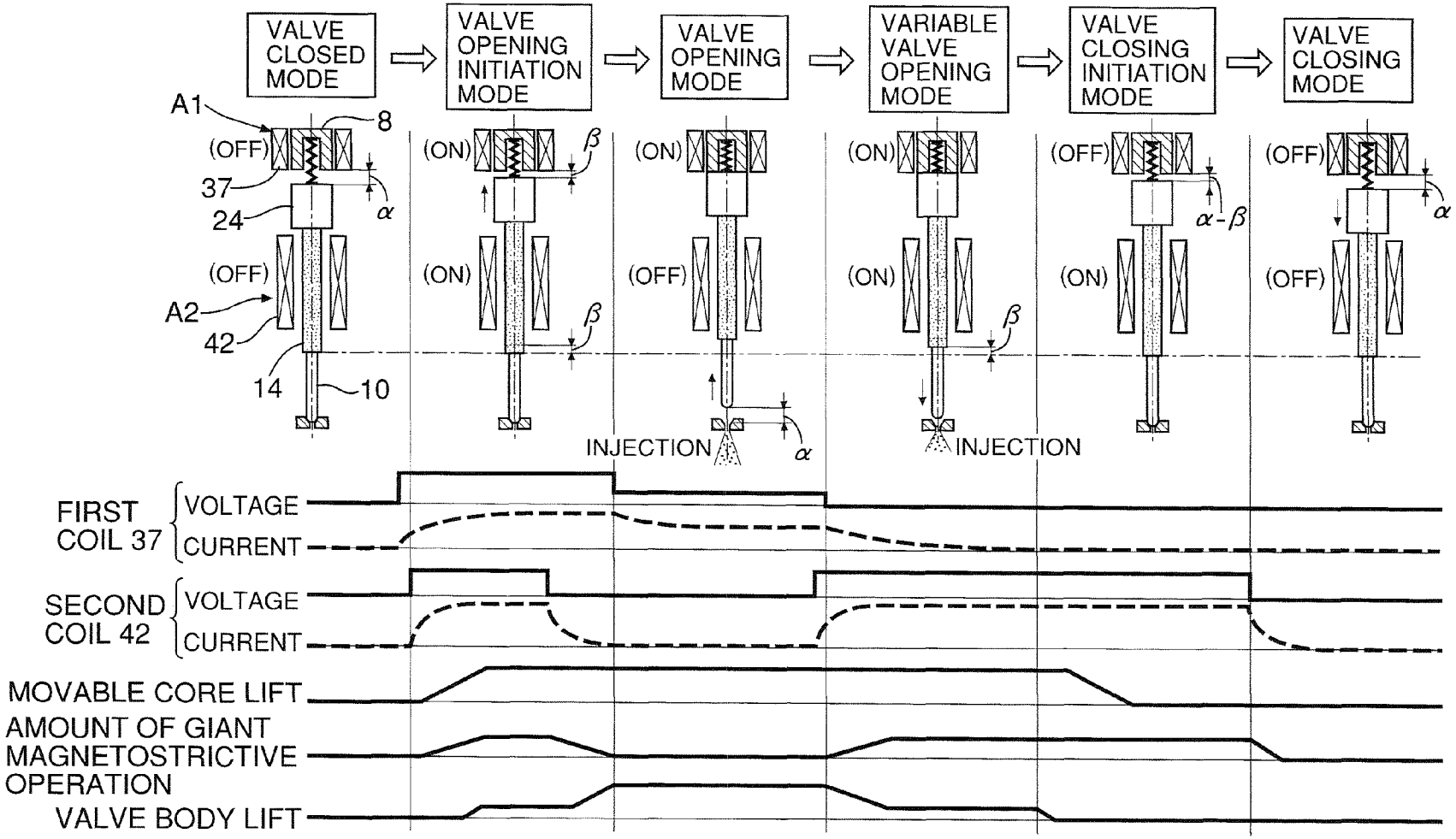
FIG. 9 a diagram for explaining a second operating mode of the fuel injection valve (first embodiment).

As shown in FIG. 7, an electronic control unit 53 is connected to the first coil 37 and the second coil 42 via a first drive circuit 51 and a second drive circuit 52; the electronic control unit 53 individually controls the operation of the first drive circuit 51 and the second drive circuit 52 based on output signals from various sensors (not illustrated) that detect engine fuel injection timing or operating state, thus individually controlling the timing with which current is passed and the amount of current passed for the first and second coils 37 and 42. In this process, in particular, the passage of current through the first coil 37 is started prior to the passage of current through the second coil 42 while taking into consideration a lag in operation of the electromagnetic actuator A1. By so doing, the amount by which responsiveness of the electromagnetic actuator A1 is lower than the responsiveness of the magnetostrictive actuator A2 can be compensated for.

The operation of the fuel injection valve I is now explained.

<First Operating Mode (See FIG. 8)>

In this first operating mode, if a stroke gap of the movable core 24 relative to the fixed core 8 when current is not passed through the first and second coils 37 and 42 is $\alpha$, an amount $\beta$ of elongation of the movable part assembly 43 by operation of the magnetostrictive actuator A2 is set so that $\beta \geqq \alpha$, for example, $\beta=\alpha$. This is utilized in order to improve opening and closing responsiveness of the valve body 10.

[Valve Closed Mode]

The first and second coils 37 and 42 are in a non-energized state, and the valve body 10 is held at a valve closed position in which it is seated on the valve seat 2 by the urging force of the return spring 31.

[Valve Opening Initiation Mode]

Current is first passed through the first coil 37, and slightly later current is passed through the second coil 42. However, since the responsiveness of the electromagnetic actuator A1, which includes the first coil 37, is slightly lower than the responsiveness of the magnetostrictive actuator A2, which includes the second coil 42, elongation of the magnetostrictive element assembly 14 occurs in practice before attraction of the movable core 24 toward the fixed core 8 side starts, and as a result, due to the relationship $\beta=\alpha$, the movable core 24 is attracted to the fixed core 8 in an early stage while the valve body 10 is held at the valve closed position, thus speeding up preparation for valve opening of the valve body 10.

[Valve Opening Mode]

Energization of the first coil 37 ensures that the movable core 24 is attracted to the fixed core 8. When the passage of current through the second coil 42 is cut off, since the set load of the preload spring 13 allows the magnetostrictive element assembly 14 to instantaneously contract by $\beta=\alpha$ and it returns to an initial state, the valve body 10 rapidly separates from the valve seat 2 by a portion corresponding to $\beta=\alpha$, thus improving the valve opening responsiveness. It is therefore possible to inject high pressure fuel that is held in readiness within the valve housing H from the fuel injection hole 3 into an engine combustion chamber with a desired timing. Moreover, since the passage of current through the second coil 42 is cut off, it is possible to save power.

Since valve opening of the valve body 10 is inward opening caused by the valve body 10 being displaced from the valve seat 2 toward the interior of the valve housing H, a spray form formed by fuel injection from the fuel injection hole 3 can be formed well without interference from the valve portion of the valve body 10.

[Valve Closing Initiation Mode]

The passage of current through the first coil 37 is cut off and at the same time current is passed through the second coil 42. Due to the passage of current through the second coil 42, the magnetostrictive element assembly 14 immediately elongates by $\alpha$, the valve body 10 is rapidly closed, and fuel injection can be stopped.

[Valve Closing Mode]

The passage of current through the second coil 42 is also cut off, thus making the magnetostrictive element assembly 14 contract to its initial state. In this step, since residual magnetism either disappears or decreases from between the movable core 24 and the fixed core 8, the movable core 24 can be separated from the fixed core 8 by the set load of the return spring 31 at the same time as the magnetostrictive element assembly 14, thereby reliably holding the valve body 10 in the valve closed state.

In the valve opening mode, as shown by a dotted line, by appropriately controlling the amount of current passed through the second coil 42 so as to decrease it or make it zero, and elongating the magnetostrictive element assembly 14 by an appropriate amount, it is possible to lower the degree of opening of the valve body 10, reduce the amount of fuel injected, and at the same time contribute to a saving of power.

[Second Operating Mode (See FIG. 9)]

In this second operating mode, when the stroke gap of the movable core 24 relative to the fixed core 8 is $\alpha$ when the first and second coils 37 and 42 are not energized, the amount $\beta$ of elongation of the movable part assembly 43 by operation of the magnetostrictive actuator A2 is set so that $\beta<\alpha$, for example, $\beta=\alpha/2$. This is utilized particularly in order to improve the opening responsiveness of the valve body 10 and enable the amount of fuel injected to be made variable.

[Valve Closing Mode]

The first and second coils 37 and 42 are not energized, and the valve body 10 is held at a valve closing position in which it is seated on the valve seat 2 by the urging force of the return spring 31. In this state, the gap a corresponding to the maximum valve opening stroke of the valve body 10 is formed between the movable core 24 and the fixed core 8.

[Valve Opening Initiation Mode]

First, current is passed through the first coil 37, and slightly later current is passed through the second coil 42. However, since the responsiveness of the electromagnetic actuator A1, which includes the first coil 37, is slightly lower than the responsiveness of the magnetostrictive actuator A2, which includes the second coil 42, in practice the magnetostrictive element assembly 14 elongates by $\beta=\alpha/2$ before attraction of the movable core 24 toward the fixed core 8 side starts, as a result the stroke gap between the movable core 24 and the fixed core 8 decreases from $\alpha$ to $\alpha/2$, and this enables attraction of the movable core 24 to the fixed core 8 by energization of the first coil 37 to be speeded up.

[Large Valve Opening Mode]

The passage of current through the first coil 37 is continued, and the passage of current through the second coil is cut off. Due to the continuous passage of current through the first coil 37, the movable core 24 is immediately attracted onto the fixed core 8 by the above-mentioned operation to thus open the valve body 10; at the same time due to the passage of current through the second coil being cut off the elongation $\alpha/2$ of the magnetostrictive element assembly 14 disappears, the valve body 10 is consequently separated from the valve seat 2 by the maximum stroke amount of $\alpha$ to thus attain a fully open state, and a large amount of fuel can be injected from the fuel injection hole 3. Moreover, cutting off the passage of current through the second coil 42 enables power to be saved.

[Small Valve Opening Mode]

The passage of current through the first coil 37 is maintained, and the passage of current through the second coil is restarted. Since the magnetostrictive element assembly 14 elongates again only by $\alpha/2$ in a state in which the movable core 24 is attracted onto the fixed core 8, the valve body 10 approaches the valve seat 2 only by $\alpha/2$ and attains a semi-open state, and the amount of fuel injected from the fuel injection hole 3 can be halved.

[Valve Closing Initiation Mode]

The passage of current through the first coil 37 is cut off while maintaining the passage of current through the second coil 42. As a result, the valve body 10 is seated on the valve seat 2 by the urging force of the return spring 31 from the semi-open state, the impact from the valve closing is small, and vibration of the valve body 10 can be prevented.

[Valve Closing Mode]

Finally, the passage of current through the second coil 42 is also cut off. Accompanying this, the movable part assembly 43 contracts, but due to the urging force of the return spring 31 there is no change in the valve closed state of the valve body 10.

Embodiment 2

Figure 10:
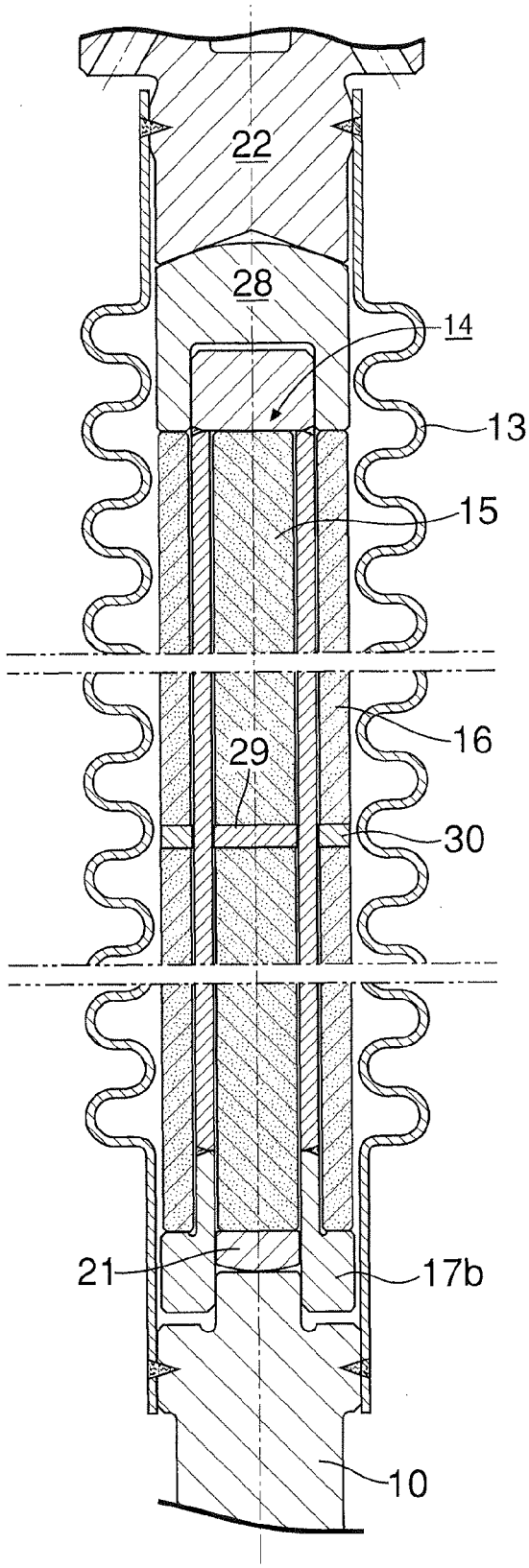
FIG. 10 is a view, corresponding to FIG. 3, showing a second embodiment of the present invention (second embodiment).

A second embodiment of the present invention is now explained by reference to FIG. 10.

In this second embodiment, a preload spring 13 is formed from a non-magnetic steel sheet bellows body, and end parts of a yoke member 22 and a valve body 10 are press-fitted into and welded to openings at axially opposite ends of the preload spring 13, thereby sealing the interior of the preload spring 13. The arrangement is otherwise the same as that of the first embodiment, and parts corresponding to the first embodiment in FIG. 10 are denoted by the same reference numerals and symbols to thus avoid duplicating the explanation.

In accordance with the second embodiment, sealing the interior of the preload spring 13 enables a magnetostrictive element assembly 14 to be shielded from fuel within a valve housing H and degradation in performance of giant magnetostrictive elements 15 and 16 to be suppressed.

The present invention is not limited to the above-mentioned embodiments, and may be modified in a variety of ways as long as the modifications do not depart from the spirit and scope of the present invention. For example, the relationship between $\alpha$ and $\beta$ and the operating mode may be changed freely according to required engine characteristics.

The invention claimed is:

1. A fuel injection valve comprising a valve body (10) that can be seated on a valve seat (2) connected to an inner end of a fuel injection hole (3), a return spring (31) that urges the valve body (10) in the seating direction, an electromagnetic actuator (A1) that, by passing current therethrough, moves the valve body (10) in an inwardly-opening direction, and a magnetostrictive actuator (A2) that, by passing current therethrough, elongates a movable part assembly (43) extending from the valve body (10) to a movable core (24) of the electromagnetic actuator (A1), wherein the magnetostrictive actuator (A2) is formed from a solid magnetostrictive element (15) provided between the valve body (10) and the movable core (24) of the electromagnetic actuator (A1) so as to couple the valve body (10) and the movable core (24), a preload spring (13) provided between the valve body (10) and the movable core (24) so as to apply a compressive preload in the axial direction of the valve body (10) to the magnetostrictive element (15), and a second coil (42) mounted on a valve housing (H) housing the valve body (10), the movable core (24), the magnetostrictive element (15), and the preload spring (13) and forming between these and the valve housing (H) a fuel flow path communicating with the fuel injection hole (3), the second coil (42) elongating the magnetostrictive element (15) against the preload by the passage of current.

2. The fuel injection valve according to claim 1, wherein control of the passage of current through the second coil (42) is carried out separately from the electromagnetic actuator (A1).

3. The fuel injection valve according to claim 1 or 2, wherein connected to one end of a magnetic material core housing tube (6), of the valve housing (H), housing the movable core (24) is a magnetic path-forming first coil housing tube (38) housing the electromagnetic actuator (A1), and connected to the other end thereof is a magnetic path-forming second coil housing tube (44) housing the second coil (42).

4. The fuel injection valve according to claim 2, wherein the passage of current through the electromagnetic actuator (A1) is started prior to the passage of current through the magnetostrictive actuator (A2) while taking into consideration a lag in operation of the electromagnetic actuator (A1).

5. The fuel injection valve according to claim 2, wherein when opening the valve body (10), the electromagnetic actuator (A1) and the magnetostrictive actuator (A2) are first operated at substantially the same time, and subsequently, while maintaining the operating state of the electromagnetic actuator (A1), the operation of the magnetostrictive actuator (A2) is canceled or the amount of operation thereof is decreased.

6. The fuel injection valve according to claim 2, wherein while the valve body (10) is opened by operation of the electromagnetic actuator (A1) the movable part assembly (43) is contracted by controlling the current passing through the magnetostrictive actuator (A2), and when the valve body (10) is closed the passage of current through the electromagnetic actuator (A1) is first cut off in while passing current through the magnetostrictive actuator (A2), and the passage of current through the magnetostrictive actuator (A2) is subsequently cut off.

* * * * *